United States Patent [19]

DeWitt

[11] 4,127,002

[45] Nov. 28, 1978

[54] METHOD FOR FORMING A CONCRETE PILING FOUNDATION

[76] Inventor: Arthur W. DeWitt, P.O. Box 20541, Portland, Oreg. 97220

[21] Appl. No.: 854,726

[22] Filed: Nov. 25, 1977

[51] Int. Cl.[2] ..... E02D 5/50

[52] U.S. Cl. ..... 405/239; 405/252

[58] Field of Search ..... 61/53, 53.5, 53.52, 61/53.62, 56, 56.5; 52/722, 725

[56] References Cited

U.S. PATENT DOCUMENTS

| | | | |
|---|---|---|---|
| 969,136 | 8/1910 | Cranford | 61/53 |
| 1,135,086 | 4/1915 | Watt | 61/53 X |
| 1,856,609 | 5/1932 | Watt | 61/53 |
| 2,430,879 | 11/1947 | Kohn | 61/53 |
| 4,033,080 | 7/1977 | Fukushima | 61/53 X |

*Primary Examiner*—Mervin Stein
*Assistant Examiner*—David H. Corbin
*Attorney, Agent, or Firm*—A. William King

[57] ABSTRACT

A process for building-up a pre-formed concrete piling while the piling is in place in terrain to form a finished piling foundation of uniform height above reference terrain level having a pre-formed portion and a cast-in-place portion.

6 Claims, 19 Drawing Figures

METHOD FOR FORMING A CONCRETE PILING FOUNDATION

BACKGROUND OF THE INVENTION

The present invention relates to the construction of concrete piling foundations and more particularly to the modular construction of in-place concrete piling foundations having a uniform height above reference terrain level.

Cast reinforced concrete piles are widely used as foundations in the construction of buildings, bridges and other structures. Due to their extremely heavy weight and comparatively low resistance to tensile bending forces, concrete piles are usually pre-formed in short lengths or sections, either with or without pretensioning, at a fabrication yard and, thereafter, the pre-formed sections are transported to the construction site whereat they are disposed vertically and driven to bearing depth in terrain by suitable pile driving equipment. For most construction, it is customary to splice-up the pre-formed sections one to the other in end-to-end relation to form an elongated continuous pile and this may be accomplished either prior to or during the pile driving operation. Known relevant disclosures of pile splicing-up techniques and related procedures include:

Cadwell, U.S. Pat. No. 731,752
Young, U.S. Pat. No. 3,338,058
Grazel, U.S. Pat. No. 3,545,214
Grazel, U.S. Pat. No. 3,593,532
Shibuya et al., U.S. Pat. No. 3,963,056
Dougherty, U.S. Pat. No. 3,988,899
Young, U.S. Pat. No. 4,009,550
Poma, U.S. Pat. No. 4,018,056

Certain problems, however, have remained in the construction and use of concrete pile sections, particularly with respect to the fact that the vertical distance to bearing depth in terrain varies considerably, even within a fairly confined geographical area. Accordingly, the uppermost part of the respective piles must be cut off with jackhammers and the like in order to obtain a finished piling foundation of uniform height above reference terrain level. Given the high acquisition and disposal costs associated with these cut off parts, which cannot be economically re-used, this present technique inherently requires considerable waste. The problem is very much aggravated by the fact that construction efficiency requires section lengths generally in the range of 10–30 feet, of which, in some cases only a few inches of the uppermost section are required to drive the pile to bearing depth in terrain.

Substantially hollow, preformed piling sections have also been presented which are spliced-up and driven to bearing and, thereafter, filled with a hardenable plastic material such as concrete to form a finished piling. Notable examples of the hollow piling technique include Kohn U.S. Pat. No. 2,430,879, Kelly et al. U.S. Pat. No. 3,899,891, and Le Clercq U.S. Pat. No. 4,018,055. This approach also involves cutting off the uppermost part of the uppermost section, and hence economical waste. Further, any reduction in economic waste, because of the substantially hollow construction employed, is severely limited by the relatively thick wall construction required to withstand the impacting forces applied to the sections as they are driven to bearing depth.

It has also been suggested (Kahn, previously cited) to fasten a threaded device to the uppermost pile portion and, thereafter, thread a shell enclosure atop the pre-formed pile portion. This shell enclosure can be cut off and filled with a hardenable plastic material to buildup a finished piling foundation of uniform height above reference terrain level. This approach, however, inherently requires that the cast-in-place portion be circular in cross section and that considerable care be taken to avoid damage to the threads of the fastening apparatus. More importantly, the installation of the threaded base portion atop the pre-formed pile portion and the subsequent operations required to thread the shell enclosure in the threaded base portion requires considerable effort and time. Obviously, at the pile drive site, in outdoor conditions, it is essential for cost savings that the splicing-up and building-up be as speedy as possible.

It is also important to consider that the widespread use of concrete piles as foundation structures has resulted largely from the high load bearing capability of concrete in compression. A concrete structure, however, particularly an elongated piles, has comparatively low load bearing capability other than in axial compression. Accordingly, when lateral loading forces are applied to the concrete piles, such as during the threading operation presented by Kohn, or the application of non-axial driving forces, it tends to produce spalling of the outer surface of the piling thereby creating the risk that interconnecting reinforcing bars will be subjected to corrosive elements. This problem is especially aggravated by the fact that the spalling often does not complete until after the interconnecting joint has been driven into the terrain thereby precluding effective inspection and repair. It will be seen that such subterranean defects will unduly shorten the load-bearing life of the resultant piling foundation and necessitate complex and costly repair operations.

SUMMARY OF THE INVENTION

The present invention avoids the above-described drawbacks of known prior art methods for forming finished concrete piling foundations by using a unique impacting technique to join a cast-in-place concrete pile portion to the top of a pre-formed concrete pile portion.

According to the principles of the present invention, an elongate pre-formed, concrete pile portion having one or more interconnected piling sections is vertically positioned and placed into terrain. The top of the pre-formed portion is provided with a metal perforated plate member and a plurality of elongate members of deformable malleable metal coupled to the pre-formed portion so as to have deformable end portions projecting from the plate member. With the pre-formed pile portion in place, an upright metal shell enclosure of any desirable cross section having a perforated base plate at its lower end is mounted upon the pre-formed pile portion such that the perforations of its base plate overlie the deformable end portions of the plate member. Accordingly, by applying an impacting force to the base plate and the deformable end portions, the shell enclosure is fixedly attached to the plate member and the pre-formed pile portion is driven to bearing depth in terrain. After pile driving is completed the uppermost part of the shell enclosure is cut off such that it projects only a predetermined distance above a reference terrain level and hardenable plastic material, such as concrete, is poured into the shell enclosure so as to form a finished piling foundation of uniform height having a preformed portion and a cast-in place portion.

It is therefore a major objective of the present invention to form a finished concrete piling foundation of uniform height above reference terrain level with a minimum amount of waste. According to the above-described method, waste is limited to the cut-off part of a thin-shell metal enclosure, much of which is readily reusable in subsequent operations.

It is a further objective to build up a piling foundation without requiring an excessive amount of time be spent in fastening a cast-in-place portion atop a pre-formed portion. In the above-described method, the shell enclosure is fixedly attached to the pre-formed portion concurrently with the step of driving the pre-formed portion to bearing depth thereby eliminating the time required by prior art methods to separately attach one piling section to another.

It is an advantageous feature of the present invention to provide a pile driving mandril having a wood cushion and a special driving head capable of performing the above-described concurrent fastening and driving steps while controlling the impacting force applied to the deformable end portions. The driving head used in the present method has recesses formed therein respectively associated with the deformable end portions which limit and shape the flattening deformation of the end portions to a predetermined configuration thereby insuring that the resultant connection will not be damaged by the subsequent impacting forces required to drive the pre-formed portion to bearing depth.

Yet another advantageous feature is to join a cast-in-place portion atop a pre-formed portion in a manner permitting subsequent impacting forces to be applied to the pre-formed portion substantially free of injurious spalling. In the present method, the deformable elongate members are embedded in the pre-formed portion so as to be spaced inwardly away from the perimeter of the pre-formed portion thereby reducing the likelihood that non-axially applied tensile forces will cause the elongate members to spall the pre-formed portion.

Still another advantageous feature of the present invention is to conveniently anchor the cast-in-place portion in the pre-formed portion. In the present method, after the pre-formed portion and shell enclosure have been driven to bearing depth in terrain, a plurality of elongate reinforcing bars are mounted inside the shell enclosure through perforations in the base plate and plate member and thence into recesses formed in the pre-formed portion so as to, when hardenable plastic material is poured into the shell enclosure and thereafter allowed to harden, anchor the cast-in-place portion in the pre-formed portion without thereby subjecting the top of the pre-formed portion to the spall-producing forces associated with transporting pile sections having reinforcing bars protruding therefrom.

The foregoing and other objectives, features and advantages of the invention will be more readily understood upon consideration of the following detailed description of the invention, taken in conjunction with the accompanying drawings.

DETAILED DESCRIPTION OF THE INVENTION

Figure 1:
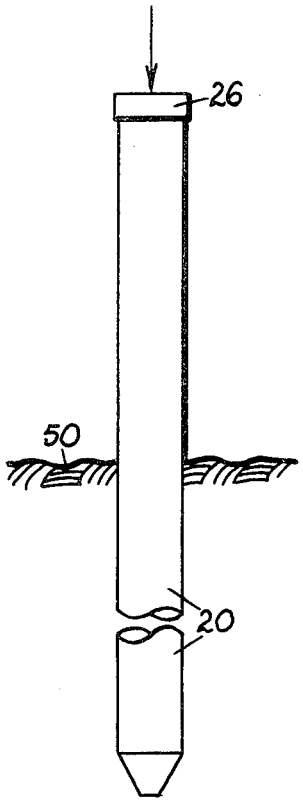
FIGS. 1–8 is a simplified plan view illustrating the steps performed in the process of forming a concrete piling foundation according to the principles of the present invention.
Figure 2:
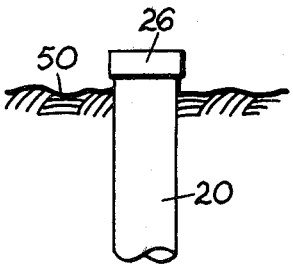
Figure 3:
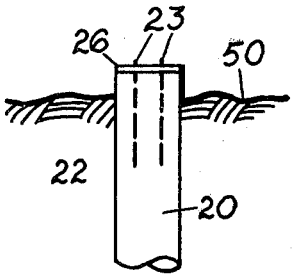
Figure 4:
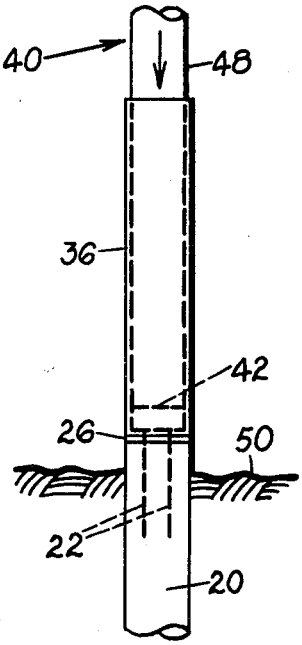
Figure 5:
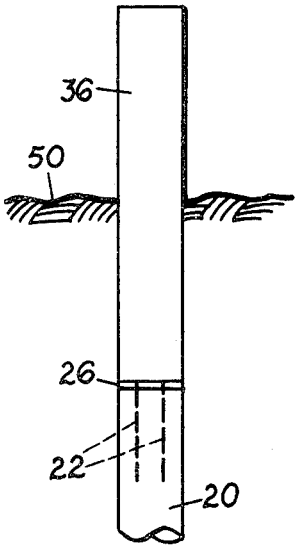
Figure 6:
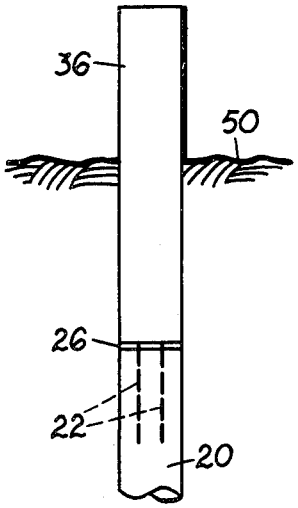
Figure 7:
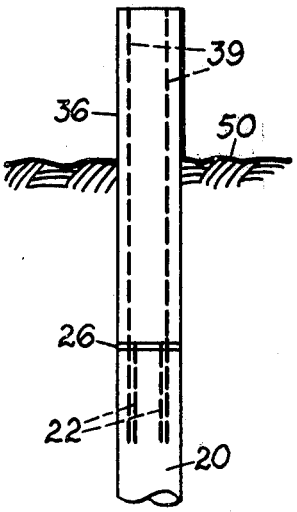
Figure 8:
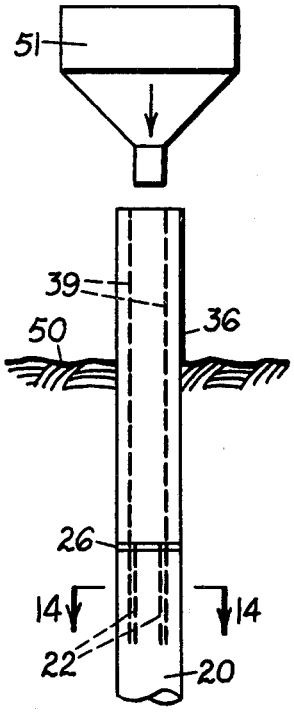
Figure 9:
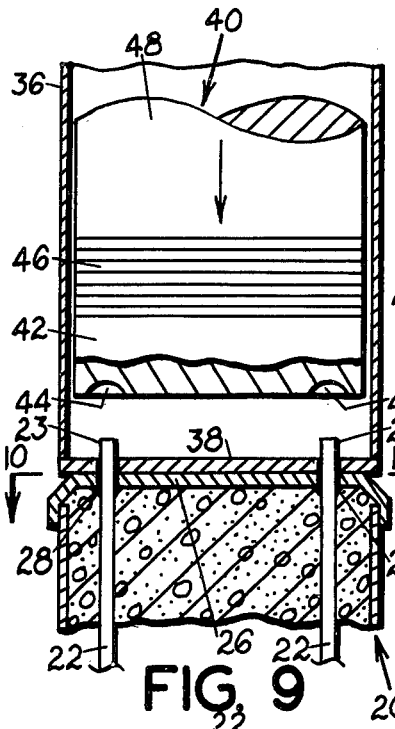
FIG. 9 is a detailed view of the apparatus used in the process of FIGS. 1–8.
Figure 13:
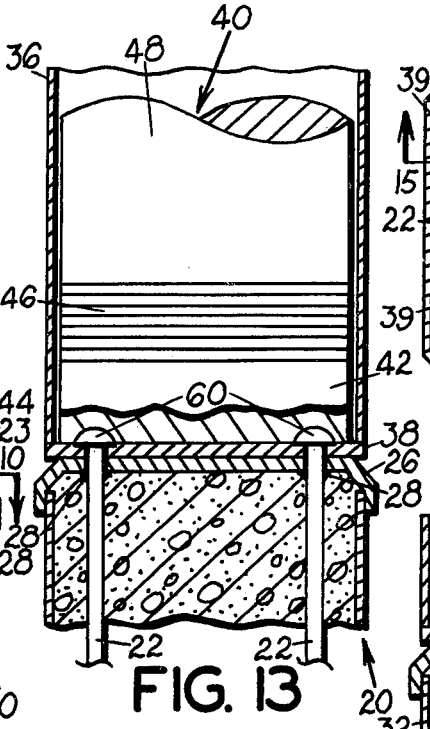
FIG. 13 is a detailed view of the apparatus used in the process of FIGS. 1–8.
Figure 14:
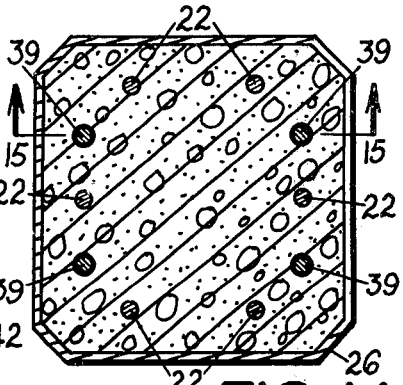
FIG. 14 is a detailed view taken along line 14-14 of FIG. 8.

Referring now to the drawings, there is shown an exemplary concrete piling foundation being formed according to the principles of the present invention wherein the numeral 20 refers to an elongate "pre-formed concrete" piling portion having one or more inter-connected sections, the term "pre-formed concrete" as used hereinafter and in the claims is representative of any pre-cast portion of hardenable plastic material including those subjected to pretensioning during the casting thereof.

Formation of the pre-formed portion 20 includes positioning a plurality of elongate members 22 of deformable malleable metal through perforations 24 formed in a substantially non-deformable metal plate member 26 so as to have deformable end portions 23 projecting from the plate member and thereafter fixedly attaching the elongate members to the plate member, such as by welding 28. Formation of the pre-formed portion is then preferably completed by inserting the opposing ends of the elongate members into the pre-formed portion during its plastic state, so as to be embedded therein and spaced inwardly away from the perimeter of the pre-formed portion when the pre-formed portion hardens, thereby fixedly attaching the plate member in overlying relation to the top of the pre-formed portion. Although the elongate members are shown as being substantially linear, it is believed that other configurations would also provide satisfactory results.

Figure 15:
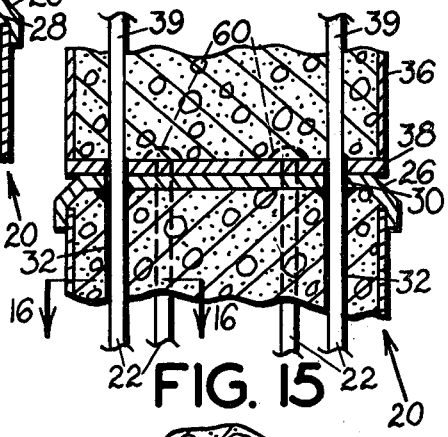
FIG. 15 is a detailed view taken along line 15-15 of FIG. 13.
Figure 10:
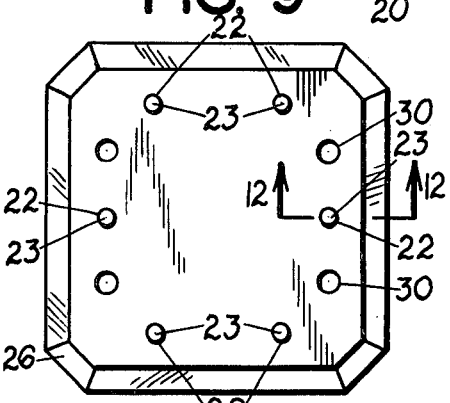
FIG. 10 is a detailed view taken along line 10-10 of FIG. 9.
Figure 12:
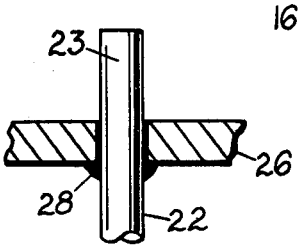
FIG. 12 is a detailed view taken along line 12-12 of FIG. 10.
Figure 16:
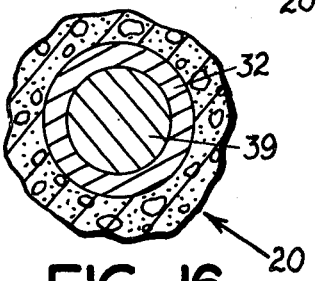
FIG. 16 is a detailed view taken along line 16-16 of FIG. 15.
Figure 11:
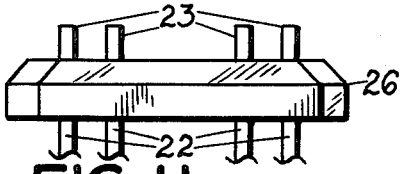
FIG. 11 is a detailed view of the apparatus used in the process of FIGS. 1–8.
Figure 17:
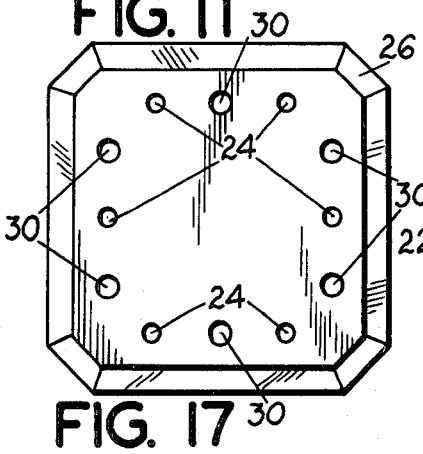
FIGS. 17–19 is a top view of alternative embodiments of the apparatus depicted in FIGS. 10 and 13.
Figure 18:
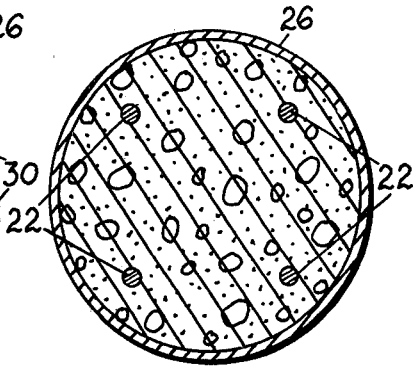
Figure 19:
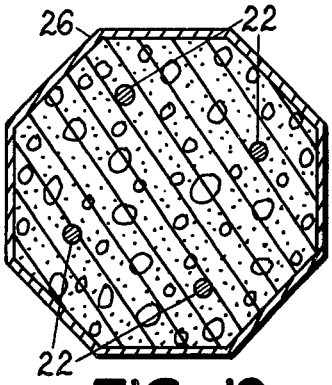

Some construction contracts expressly require that all built-up or spliced-up piling portions must include a predetermined plurality of reinforcing bars having their respective ends embedded to a predetermined depth in the respective interconnectionary sections thereof. In such cases, formation of the top of the pre-formed portion 20 includes forming additional perforations 30 in the plate member suitable for receiving the reinforcing bars therethrough and forming a plurality of corresponding dowel recesses 32 (FIG. 15) in the top of the pre-formed portion. It should also be noted that off-site manufacture includes building an elongate upright shell enclosure 36, preferably having relatively thin metal walls and a metal base plate 38 fixedly attached at one end thereof, such as by welding. The construction of the shell enclosure further includes forming perforations in the base plate which correspond in cross section and configuration respectively to the elongate members embedded in, and the dowel recesses formed in, the top of the pre-formed portion.

Turning now to FIGS. 1–8, the above-described apparatus is conveyed to a pile-driven site whereat initial piling foundation formation includes vertically positioning and placing the pre-formed portion 20 in terrain 50 so that the lowermost extremity of the preformed portion is within a predetermined distance from bearing depth with the top of the pre-formed portion adjacent the surface of the terrain. With the preformed portion in place, intermediate piling foundation construction includes mounting the shell enclosure 36 atop the preformed portion such that respective ones of the perforations in the base plate 38 overlie the deformable end portions 23 of the elongate members 22; and thereafter, moving the driving head of pile-driving equipment through the shell enclosure thereby applying repetitive impacting forces to the deformable end portions and the base plate, the initial impacting forces both deforming the deformable end portions to fixedly attach the base plate to the plate member and drive the shell enclosure and pre-formed portion toward bearing depth; whereas, the subsequent impacting forces are controlled and limited, as hereinafter described, so as to be applied only to the base plate thereby driving the pre-formed portion to bearing depth. In this respect, it is important to note that the elongate members and dowel recesses 32 are geometrically arranged about the longitudinal axis of the pre-formed portion and are spaced inwardly away from the perimeter of the pre-formed portion so as to prevent the impacting forces from spalling the preformed portion.

Once bearing depth has been attained, construction is completed by cutting off the shell enclosure 36 at a reference terrain level; mounting a plurality of elongate reinforcing bars inside the shell enclosure through the perforations 30 in the plate member 26 and thence into the dowel recesses 32 formed in the top of the preformed portion 20; and, pouring a hardenable plastic material, such as concrete, into the shell enclosure so as to form a finished piling foundation of uniform height above reference terrain level having a pre-formed portion 20 and a cast-in-place portion.

It is particularly important to note that a special driving head 40 is used in the present method which includes a driving face 42 having a plurality of shaping recesses 44 formed therein, and a wood cushion 46 releasably secured to its elongate mandril 48. The shell enclosure 36 defines an interior space sufficient to receive the driving head therein and the walls of the shell enclosure are spaced sufficiently away from the deformable end portions 23 as to permit the driving face 42 to repeatedly engage the base plate 38 with the shaping recesses 44 of the driving face in surrounding relation to the deformable end portions. The importance of these features include the fact that the shaping recesses automatically control the impacting forces applied to the deformable end portions so as to limit and shape the deformation of the deformable end portions to obtain rivet heads 60 of predetermined cross-section and configuration.

The terms and expressions which have been employed in the foregoing abstract and specification are used therein as terms of description and not of limitation, and there is no intention in the use of such terms and expressions, of excluding equivalents of the features shown and described, or portions thereof, it being recognized that the scope of the invention is defined and limited only by the claims which follow.

What is claimed is:

1. A method for building-up an elongate pre-formed concrete pile portion while said pre-formed portion is in place in terrain to form a finished piling foundation of uniform height, comprising;

(a) placing in terrain an elongate pre-formed concrete pile portion having a plate member overlying the upper end thereof and a plurality of elongate members of deformable malleable metal fixedly attached to said plate member so as to have deformable end portions projecting from said plate member;

(b) mounting an upright shell enclosure of a first predetermined height, having a base plate with a plurality of perforations at one end thereof, upon said pre-formed portion while in place in terrain such that said perforations in said base plate overlie said deformable end portions of said plate member with said deformable end portions extending into said shell enclosure and with said shell enclosure mechanically supported by said pre-formed portion;

(c) applying an impacting force with the driving hammer of suitable pile driving equipment upon a follower placed inside said shell enclosure in engagement with said deformable end portions causing deformation of said deformable end portions so as to fixedly attach said base plate, and thereby said shell enclosure, to said plate member of said preformed portion;

(d) driving both said pre-formed portion and said shell enclosure simultaneously to bearing depth in said terrain;

(e) after step (d) cutting off an upper portion of said shell enclosure such that said shell enclosure has a second predetermined height and projects only a predetermined distance above a reference terrain level; and (f) pouring a hardenable plastic material into said shell enclosure so as to form a finished piling foundation of uniform height having a preformed portion and a cast-in-place portion.

2. The method of claim 1 including, after step (d), mounting a plurality of elongate reinforcing bars inside said shell enclosure through said perforations in said base plate, through perforations formed in said plate member and thence into recesses formed in said preformed portion so as to, when said hardenable plastic material is poured into said shell enclosure and thereafter allowed to harden, anchor said formed-in-place portion in said pre-formed portion.

3. A method for building-up an elongate pre-formed concrete pile portion while said pre-formed portion is in place in terrain to form a finished piling foundation of uniform height, comprising:

(a) placing in terrain an elongate pre-formed concrete pile portion having a plate member overlying the upper end thereof and a plurality of elongate members of deformable malleable metal embedded in said pre-formed portion so as to have deformable end portions projecting from said plate member;

(b) mounting an upright shell enclosure of a first predetermined height, having a base plate with a plurality of perforations at one end thereof, upon said pre-formed portion while in place in terrain such that said perforations in said base plate overlie said deformable end portions with said deformable end portions extending into said shell enclosure and with said shell enclosure mechanically supported by said pre-formed portion;

(c) applying an impacting force with the driving hammer of suitable pile driving equipment upon a follower placed inside said shell enclosure in engagement with said deformable end portions and thereby to said deformable end portions and said base plate so as to both deform said deformable end portions fixedly attaching said shell enclosure to said pre-formed portion and simultaneously driving said pre-formed portion toward bearing depth in terrain;

(d) after step (c) applying said impacting force by means of said driving hammer and follower to said base plate substantially independently of the deformed end portions so as to drive said preformed portion to bearing depth;

(e) after step (d) cutting off an upper portion of said shell enclosure such that said shell enclosure has a second predetermined height and projects only a predetermined distance above a reference terrain level; and (f) pouring a hardenable plastic material into said shell enclosure so as to form a finished piling foundation of uniform height having a pre-formed portion and a cast-in-place portion.

4. The method of claim 3 including, after step (d), mounting a plurality of elongate reinforcing bars inside said shell enclosure through said perforations in said base plate, through perforations formed in said plate member and thence into recesses formed in said pre-formed portion so as to, when said hardenable plastic material is poured into said shell enclosure and thereafter allowed to harden, anchor said formed-in-place portion in said pre-formed portion.

5. A method for building up an elongate pre-formed concrete pile portion while said pre-formed portion is in place in terrain to form a finished piling foundation of uniform height, comprising:

(a) placing in terrain an elongate pre-formed concrete pile portion having a plate member overlying the upper end thereof and a plurality of elongate members of deformable malleable metal coupled with said pre-formed portion so as to have deformable end portions projecting from said plate member;

(b) mounting an upright shell enclosure of a first predetermined height, having a base plate with a plurality of perforations at one end thereof, upon said pre-formed portion while in place in terrain such that said perforations in said base plate overlie said deformable end portions with said deformable end portions extending into said shell enclosure and with said shell enclosure mechanically supported by said pre-formed portion;

(c) applying an impacting force with the driving hammer of suitable pile driving equipment upon a follower placed inside said shell enclosure in engagement with said deformable end portions and said base plate and thereby to said deformable end portions and said base plate so as to both deform said deformable end portions fixedly attaching said shell enclosure to said pre-formed portion and drive said pre-formed portion simultaneously toward bearing depth in terrain;

(d) after step (c) applying an impacting force to said base plate so as to drive said pre-formed portion to bearing depth;

(e) after step (d) cutting off an upper portion of said shell enclosure such that said shell enclosure has a second predetermined height and projects only a predetermined distance above a reference terrain level; and (f) pouring a hardenable plastic material into said shell enclosure so as to form a finished piling foundation of uniform height having a pre-formed portion and a cast-in-place portion.

6. The method of claim 5 including, after step (d), mounting a plurality of elongate reinforcing bars inside said shell enclosure through said perforations in said base plate, through perforations formed in said plate member and thence into recesses formed in said pre-formed portion so as to, when said hardenable plastic material is poured into said shell enclosure and thereafter allowed to harden, anchor said formed-in-place portion in said pre-formed portion.

* * * * *